US005708911A

United States Patent [19]

Kageyama et al.

[11] Patent Number: 5,708,911

[45] Date of Patent: Jan. 13, 1998

[54] IMAGE FORMING APPARATUS WHICH DETECTS ROTATION OF A CONTINUOUS SHEET FEEDING REEL AND JUDGES WHETHER THE END OF THE SHEET IS FIXED TO THE FEEDING REEL

[75] Inventors: Hiroshi Kageyama; Katsuhiro Yoshiuchi; Yoko Nishi, all of Osaka, Japan

[73] Assignee: Mita Industrial Co., Ltd., Osaka, Japan

[21] Appl. No.: 685,670

[22] Filed: Jul. 26, 1996

[30] Foreign Application Priority Data

Jul. 31, 1995 [JP] Japan ..... 7-195242

[51] Int. Cl.[6] ..... B65H 19/00

[52] U.S. Cl. ..... 399/23; 399/384

[58] Field of Search ..... 355/27, 28, 29; 399/23, 43, 384, 385, 391; 83/203, 210, 364, 365, 649

[56] References Cited

U.S. PATENT DOCUMENTS

| | | | |
|---|---|---|---|
| 3,687,542 | 8/1972 | Suzuki et al. | 355/28 |
| 4,286,487 | 9/1981 | Rubel | 83/58 |
| 4,360,263 | 11/1982 | Miyoshi et al. | 355/29 |
| 4,885,613 | 12/1989 | Kudoh | 399/23 |
| 5,107,296 | 4/1992 | Ozawa et al. | 355/28 |
| 5,396,313 | 3/1995 | Zoltner et al. | 399/23 |

FOREIGN PATENT DOCUMENTS

| | | |
|---|---|---|
| 597 823 | 5/1994 | European Pat. Off. . |
| 722 127 | 7/1996 | European Pat. Off. . |
| 29 48 012 | 7/1981 | Germany . |
| 58-78944 | 5/1983 | Japan . |
| 8-127119 | 5/1996 | Japan . |

*Primary Examiner*—Arthur T. Grimley
*Assistant Examiner*—Quana Grainger
*Attorney, Agent, or Firm*—Beveridge, DeGrandi, Weilacher & Young, LLP

[57] ABSTRACT

An image forming apparatus having a structure in which it is judged whether or not the trailing end of a continuous sheet is fixed to a feeding reel. The continuous sheet wound around the feeding reel is pulled out, and is conveyed through a conveying path passing through an image forming section. When the continuous sheet is conveyed, the rotation or the stop of the feeding reel is detected. When the stop of the rotation of the feeding reel is detected while the continuous sheet is being conveyed, it is judged that the continuous sheet has been used up. The continuous sheet is further conveyed for a predetermined time period after the judgment. It is judged whether or not the trailing end of the continuous sheet is fixed to the feeding reel depending on whether or not the continuous sheet exists in a predetermined position of the conveying path.

10 Claims, 5 Drawing Sheets

IMAGE FORMING APPARATUS WHICH DETECTS ROTATION OF A CONTINUOUS SHEET FEEDING REEL AND JUDGES WHETHER THE END OF THE SHEET IS FIXED TO THE FEEDING REEL

BACKGROUND OF THE INVENTION

1. Field of the Invention

The present invention relates generally to an image forming apparatus for pulling out a continuous sheet wound around a feeding reel and forming an image on the sheet. The present invention further relates to a method of removing, when a continuous sheet is used up, the sheet within a conveying path.

2. Description of the Related Art

An electrophotographic copying machine so adapted as to illuminate and scan an original, form an electrostatic latent image on a photoreceptor by light reflected from the original, develop the electrostatic latent image into a toner image, and fix the toner image to copy sheets by heating has been widely used. A copying machine capable of copying an original of large size, for example, AO size in Japanese Industrial Standard (JIS) (hereinafter referred to as "AO size") has been provided.

The copying machine capable of copying an original of large size comprises a reading mechanism capable of reading an original of large size, and a conveying mechanism for conveying copy sheets of large size corresponding to the original size.

As the copy sheets, a long strip-shaped continuous sheet may be used in many cases. The continuous sheet is pulled out from a rolled-sheet body formed by winding the continuous-sheet around a feeding reel. The reason for this is that cut sheets of predetermined size, for example, AO size are inconvenient in handling and requires a wide containing space.

There are two types of rolled-sheets, that is, a rolled-sheet whose trailing end is fixed to the feeding reel by bonding, for example (hereinafter referred to as a "bonded rolled-sheet"), and a rolled-sheet whose trailing end is not fixed thereto (hereinafter referred to as an "unbonded rolled-sheet").

However, the conventional apparatus does not incorporate a mechanism for judging which of the bonded rolled-sheet and the unbonded rolled-sheet is a rolled-sheet being used. When the rolled-sheet is used up, therefore, it cannot be suitably judged whether the rolled-sheet is to be rewound around the feeding reel or the rolled-sheet is to be all discharged.

SUMMARY OF THE INVENTION

An object of the present invention is to provide, in an image forming apparatus for forming an image on a continuous sheet, an image forming apparatus having a structure in which it can be judged whether or not the trailing end of the continuous sheet is fixed to a feeding reel.

Another object of the present invention is to provide an image forming apparatus capable of removing a continuous sheet in a conveying path in a suitable way depending on whether or not the trailing end of the continuous sheet is fixed to a feeding reel.

Still another object of the present invention is to provide a method in which when a continuous sheet is used up, the continuous sheet remaining in a conveying path can be discharged in a suitable way.

An image forming apparatus according to the present invention comprises sheet conveying means for pulling out a continuous sheet wound around a feeding reel and conveying the sheet through a predetermined conveying path passing through image forming means, reel rotation detecting means for detecting the rotation or the stop of the feeding reel, and sheet detecting means for detecting the presence or absence of the continuous sheet in a predetermined position of the conveying path. When the stop of the rotation of the feeding reel is detected while the continuous sheet is being conveyed, it is judged whether or not the trailing end of the continuous sheet is fixed to the feeding reel on the basis of an output of the sheet detecting means.

If the trailing end of the continuous sheet is fixed to the feeding reel, a pulling force from the feeding reel is exerted on the continuous sheet when the rolled-sheet has been used up, so that the continuous sheet cannot be conveyed any more. Correspondingly, the rotation of the feeding reel is stopped. Unless the trailing end of the continuous sheet is fixed to the feeding reel, a force from the continuous sheet is not exerted on the feeding reel when the continuous sheet has been used up, so that the rotation of the feeding reel is stopped. Even in either case, therefore, it can be judged that the continuous sheet has been used up on the basis of the stop of the rotation of the feeding reel.

In a case where the conveyance of the continuous sheet is continued even after the continuous sheet has been used up, if the trailing end of the continuous sheet is fixed to the feeding reel, the continuous sheet stays in the conveying path. On the contrary, unless the trailing end of the continuous sheet is fixed to the feeding reel, the continuous sheet is conveyed through the conveying path without staying. If the output of the sheet detecting means which is arranged in a predetermined position of the conveying path is monitored, therefore, it can be judged whether or not the trailing end of the continuous sheet is fixed to the feeding reel.

More specifically, after the reel rotation detecting means has detected the stop of the rotation of the feeding reel, the sheet is conveyed by the sheet conveying means for a predetermined time period. By examining the output of the sheet detecting means after the conveyance of the sheet for the predetermined time period, it can be judged whether or not the trailing end of the continuous sheet is fixed to the feeding reel.

The image forming apparatus according to one embodiment of the present invention is operated to discharge the sheet in the conveying path in response to the judgment that the trailing end of the continuous sheet is not fixed to the feeding reel. Consequently, no sheet remains in the conveying path, which does not interfere with the setting of the subsequent continuous sheet.

When it is judged that the trailing end of the continuous sheet is fixed to the feeding reel, it is preferable that the feeding reel is driven to rotate in order to rewind the continuous sheet in the conveying path around the feeding reel. Even when the trailing end of the continuous sheet is fixed to the feeding reel, therefore, no sheet remains in the conveying path.

The apparatus according to one embodiment of the present invention further comprises cutter means provided in a predetermined position of the conveying path for cutting the continuous sheet, and second sheet detecting means for detecting the presence or absence of the sheet in a predetermined position of the conveying path on the downstream side of the cutter means. In this case, if it is judged that the trailing end of the continuous sheet is fixed to the feeding reel, and the second sheet detecting means is in detection of the continuous sheet, it is preferable that the cutter means is operated. It is preferable that a sheet piece cut from the continuous sheet by the cutter means is discharged by driving the sheet conveying means. Further, it is preferable that the feeding reel is driven to rotate, to return to the feeding reel a portion of the continuous sheet whose trailing end is fixed to the feeding reel.

As a result, the sheet can be quickly removed from the conveying path even where a long continuous sheet portion has been pulled out from the feeding reel. That is, the processing can be increased in speed if a sheet piece cut from the long continuous sheet portion by the cutter means is discharged and the remaining continuous sheet portion is rewound around the feeding reel in parallel, as compared with a case where the entire long continuous sheet portion is returned to the feeding reel. The cutting of the continuous sheet by the cutter means prevents a sheet portion having an image formed thereon from being returned to the conveying path on the upstream side of the image forming means, thereby preventing the conveying path and components appendant thereto from being contaminated.

The reel rotation detecting means may be pulse outputting means for outputting pulses as the feeding reel is rotated. In this case, it is possible to detect the stop of the rotation of the feeding reel by the fact that no pulses are outputted.

If the reel rotation detecting means detects the stop of the rotation of the feeding reel while the continuous sheet is being conveyed by the sheet conveying means, it is preferable that the display device indicates that the continuous sheet is used up.

A method of removing a continuous sheet from a conveying path in the present invention comprises the steps of judging whether or not the continuous sheet has been used up, and judging whether or not the trailing end of the continuous sheet is fixed to a feeding reel if it is judged that the continuous sheet has been used up. If it is judged that the trailing end of the continuous sheet is not fixed to the feeding reel, the sheet is conveyed in a direction of sheet conveyance through the conveying path and is discharged. If it is judged that the trailing end of the continuous sheet is fixed to the feeding reel, the continuous sheet is rewound around the feeding reel.

Consequently, the sheet can be removed from the conveying path in a suitable way depending on whether or not the trailing end of the continuous sheet is fixed to the feeding reel.

It can be judged whether or not the trailing end of the continuous sheet is fixed to the feeding reel specifically by further conveying the continuous sheet in the direction of sheet conveyance for a predetermined time period after it is judged that the continuous sheet has been used up and judging the presence or absence of the continuous sheet in a predetermined position of the conveying path after the continuous sheet is conveyed for the predetermined time period.

Furthermore, it is preferable that there is provided cutter means for cutting the continuous sheet in a halfway portion of the conveying path, and the presence or absence of the continuous sheet in a predetermined position of the conveying path on the downstream side of the cutter means in the direction of sheet conveyance is detected after the continuous sheet has been conveyed for the predetermined time period. It is preferable that if the presence of the continuous sheet in the predetermined position is detected, the cutter means is operated to cut the continuous sheet prior to rewinding of the continuous sheet around the feeding reel. Further, it is preferable to convey a sheet piece cut from the continuous sheet in the direction of sheet conveyance and discharge the sheet piece to the outside of the image forming apparatus.

As a result, when a pulled-out portion of the continuous sheet is long, the sheet in the conveyance path can be quickly removed by discharging a sheet piece cut from the continuous sheet by the cutter means and rewinding the pulled-out portion of the continuous sheet around the feeding reel in parallel.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
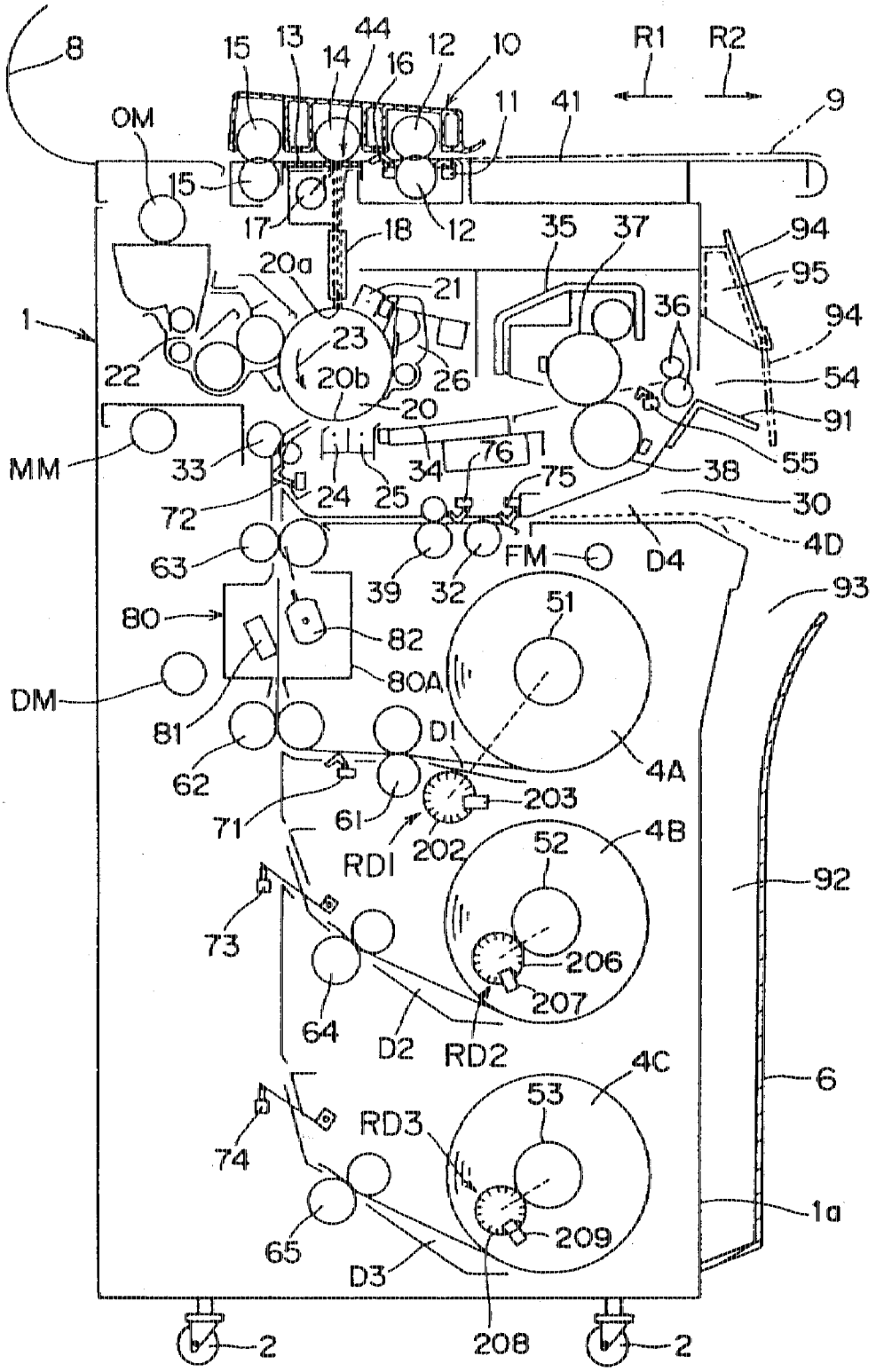
FIG. 1 is a sectional side elevation view schematically showing the internal construction of a copying machine according to one embodiment of an image forming apparatus in the present invention.
Figure 2:
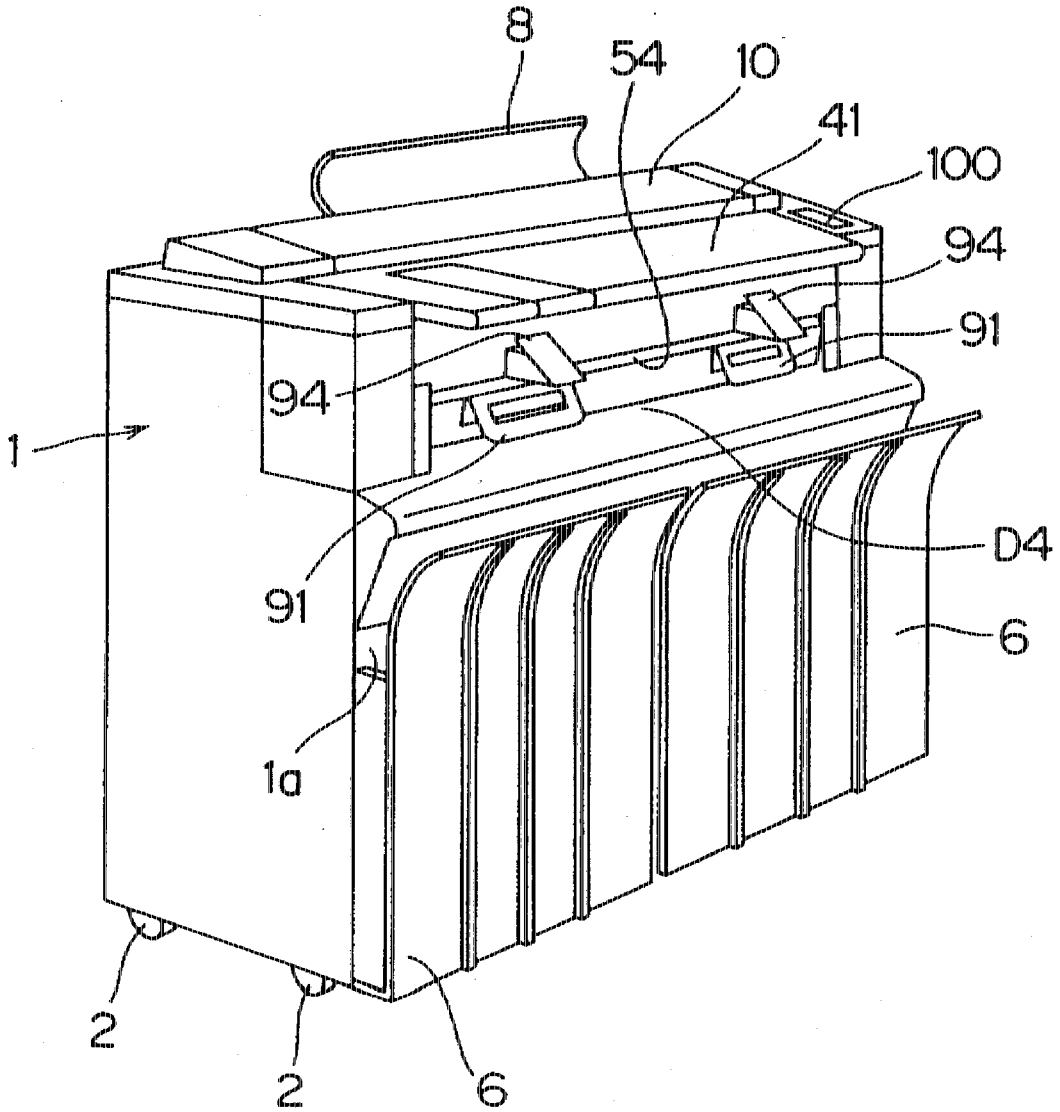
FIG. 2 is a perspective view showing the appearance of the copying machine shown in FIG. 1.
Figure 3:
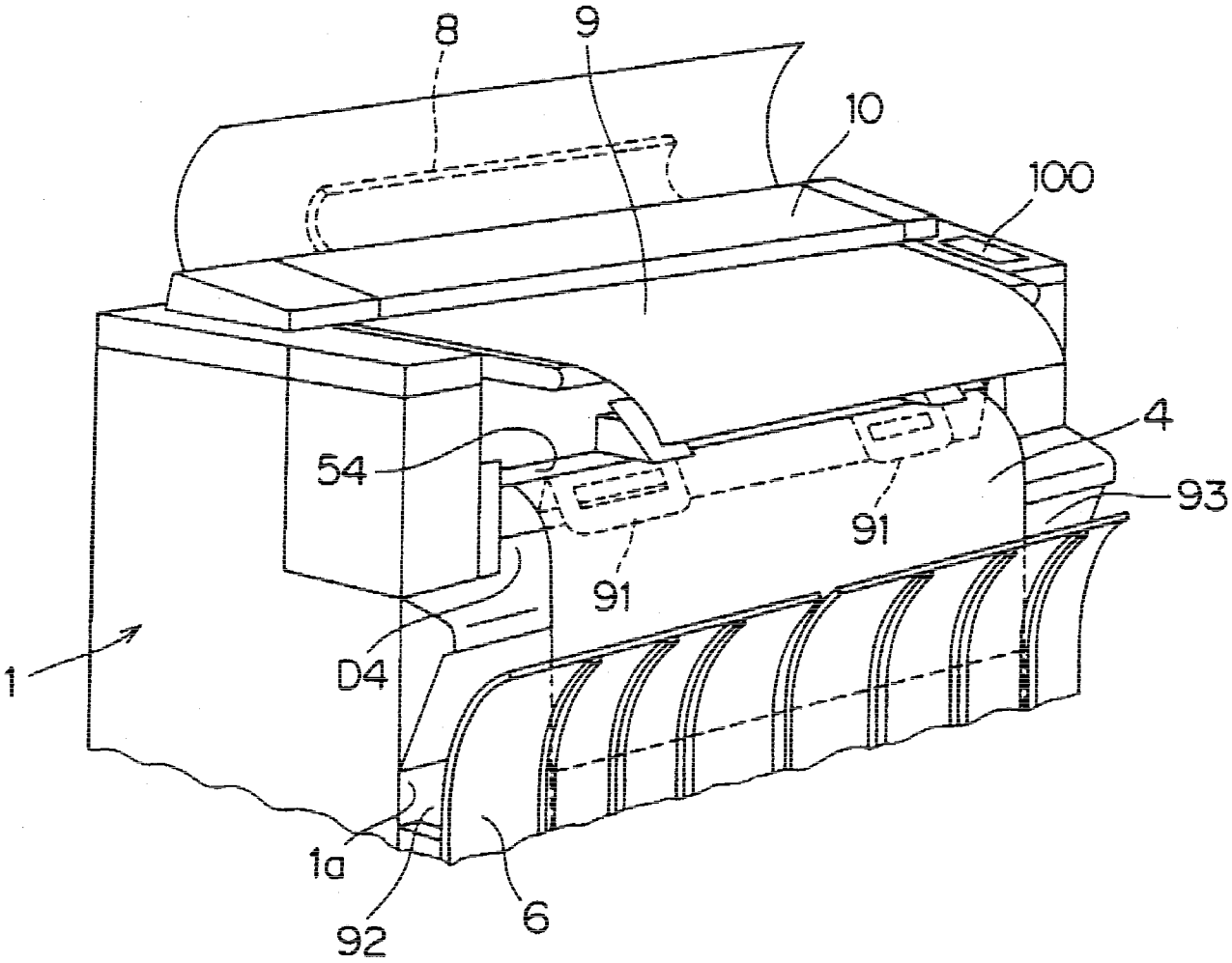
FIG. 3 is a perspective view showing the partial appearance at the time of copying of the copying machine shown in FIG. 1 in an enlarged manner.

FIG. 1 is a sectional side elevation view schematically showing the internal construction of a copying machine according to one embodiment of an image forming apparatus in the present invention, FIG. 2 is a perspective view showing the appearance of the copying machine, and FIG. 3 is a perspective view partially showing the appearance at the time of copying of the copying machine in an enlarged manner. The copying machine is for obtaining a copy image of an original of large size such as AO size. In the copying machine, the original is conveyed, while an original surface is illuminated and scanned by an optical system fixedly arranged, whereby an image is formed on the basis of the illumination and scanning.

A main body 1 of the copying machine has caster wheels 2 provided on its bottom, which is made movable. An original conveying section 10 for conveying an original 9 along an original conveying path 41 formed on the upper surface of the main body 1 of the copying machine is provided on the top of the main body 1. A discharge port 54 for a discharging sheet to which a toner image has been transferred is opened on a front surface 1*a* of the main body 1. The sheets discharged from the discharge port 54 are dropped with their leading ends directed downward while being guided by guiding members 91 as shown in FIG. 3, and the dropped sheets are successively contained in a pocket 92 formed by a front cover 6 along the front surface 1*a* of the main body 1 through an inlet opening 93. An operation section 100 having switches, keys, and the like for performing various setting related to copying arranged therein is provided in an end on the upper surface of the main body 1.

Referring to FIG. 1, rolled-sheets 4A, 4B, and 4C in three stages, i.e., upper, intermediate and lower stages which are wound in a roll shape are contained in a portion below the center along the height of the main body 1 of the copying machine. The rolled-sheets 4A, 4B, and 4C are strip-shaped continuous sheets and are respectively wound around feeding reels 51, 52, and 53. Examples of the rolled-sheets 4A, 4B, and 4C include a plain paper sheet, film, and tracing paper sheet. For example, different types of sheets are respectively set in the main body 1 as the rolled-sheets 4A, 4B, and 4C. A bypass conveying path D4 for feeding a cut sheet 4D having a predetermined length such as a cut sheet of AO size to A4 size through a manual sheet feeding section 30 on the front surface la of the main body 1 of the copying machine is provided in the center of the main body 1.

The rolled-sheet 4A in the upper stage is delivered from the feeding reel 51 and is conveyed along first conveying path D1 leading to a photosensitive drum 20 successively through sheet feeding rollers 61, a sheet feeding switch 71 for detecting the leading end of the rolled-sheet 4A conveyed, conveying rollers 62, a cutter mechanism 80, registration rollers 63, a registration switch 72 for detecting the leading end of each of the rolled-sheets 4A, 4B, and 4C and the cut sheet 4D conveyed, and conveying rollers 33.

The rolled-sheet 4B in the intermediate stage is delivered from the feeding reel 52 and is conveyed along a second conveying path D2 leading to the photosensitive drum 20 successively through sheet feeding rollers 64, a sheet feeding switch 73 for detecting the leading end of the rolled-sheet 4B conveyed, the conveying rollers 62, the cutter mechanism 80, the registration rollers 63, the registration switch 72, and the conveying rollers 63. A path succeeding the conveying rollers 62 is common to the first conveying path D1.

The rolled-sheet 4C in the lower stage is delivered from the feeding reel 53 and is conveyed along a third conveying path D3 leading to the photosensitive drum 20 successively through sheet feeding rollers 65, a sheet feeding switch 74 for detecting the leading end of the rolled-sheet 4C conveyed, the conveying rollers 62, the cutter mechanism 80, the registration rollers 63, the registration switch 72, and the conveying rollers 33. A path succeeding the conveying rollers 62 is common to the first conveying path D1.

The above-mentioned bypass conveying path D4 is a path for leading to the photosensitive drum 20 the cut sheet 4D introduced from the manual sheet feeding section 30 successively through a fifth leading end detecting switch 75 for detecting the leading end of the cut sheet 4D conveyed, a separating roller 32 for feeding the cut sheets 4D while separating the cut sheets (separating one at a time) by sliding contact with a friction plate (not shown), a manual sheet feeding switch 76 for detecting the leading end of the cut sheet 4D conveyed, registration rollers 39, the registration switch 72, and the conveying rollers 33. A path succeeding the registration switch 72 in the bypass conveying path D4 is common to the first conveying path D1.

The above-mentioned cutter mechanism 80 comprises, in a casing 80A, a longitudinal fixed blade 81 extending in a direction perpendicular to the direction of conveyance of the rolled-sheets 4A to 4C and a rotating blade 82 for cutting the rolled-sheets 4A to 4C between the fixed blade 81 and the rotating blade 82.

The above-mentioned original conveying section 10 is for conveying the original 9 and is capable of switching the direction of conveyance between a forward direction R1 and a reverse direction R2. An image forming operation is performed when the original is conveyed in the forward direction R1. When a plurality of copies are made from the same original, the original conveying section 10 alternatively switches the direction of conveyance to the forward direction R1 and the reverse direction R2, to convey the original 9. The above-mentioned original conveying path 41 is formed on the upper surface of the main body 1, extending to a position where it projects from the upper surface of the main body 1 on the upstream side of the original conveying section 10 with respect to the forward direction R1.

The original conveying section 10 is constructed by successively arranging a first original end detecting switch 11, original conveying rollers 12, a second original end detecting switch 16, an original conveying roller 14, and original conveying rollers 15 along the forward direction R1.

The original conveying rollers 12 start to be driven upon switching of the first original end detecting switch 11 from its off state to its on state to detect the leading end of the original 9 (an end on the downstream side in the forward direction R1). The original conveying roller 14 is provided in a position opposite to a transparent plate 13 for bringing the original 9 into contact with the transparent plate 13 in order to subject the original 9 to slit exposure. The original conveying rollers 15 discharge the original 9 after being exposed.

The second original end detecting switch 16 is switched from its off state to its on state when the original 9 is conveyed in the forward direction R1, to detect the leading end of the original 9. The conveyance of the rolled-sheet 4A, 4B or 4C (the rolled sheet 4A, 4B or 4C conveyed for copying is hereinafter merely referred to a "rolled-sheet 4") is started in response to turning-on of the second original end detecting switch 16. As a result, the conveyance of the original 9 and the conveyance of the rolled-sheet 4 are synchronized with each other.

The first original end detecting switch 11 is switched from its on state to its off state when the original 9 is conveyed in the forward direction R1, to detect the trailing end of the original 9. The cutter mechanism 80 is driven at predetermined timing after an elapse of predetermined time from the timing of the detection, so that the rolled-sheet 4 is cut. In the present embodiment, the length of a conveying path of the rolled-sheet 4 from the cutter mechanism 80 to a transferring corona discharger 24 (a position for transfer 20*b*) is set to a larger length than the length of an original conveying path from the first original end detecting switch 11 to a position for original exposure 44 by a peripheral length from a position for exposure 20*a* of the photosensitive drum 20 to the position for transfer 20*b*. Consequently, an image corresponding to the trailing end of the original 9 can be formed at the trailing end of a sheet cut from the rolled-sheet 4 at the above-mentioned timing.

The second original end detecting switch 16 is switched from its on state to its off state when the original 9 is conveyed in the reverse direction R2, to detect the leading end of the original 9 (the trailing end of the original in the reverse direction R2). In response to that the second original end detecting switch 16 is turned off, the driving of the conveying rollers 12, 14 and 15 is stopped. At this time, there occurs a state where the leading end of the original 9 in the forward direction R1 is held by the conveying rollers 12, thereby making the original 9 available for the subsequent copying operation. Reference numeral 8 denotes a reversing member for reversing the direction of the original to prevent the original 9 from dropping into the back of the main body 1.

A light source 17 for illuminating the original surface of the original 9 is fixedly arranged in relation to the transparent plate 13. Light from the light source 17 is irradiated onto the surface of the original 9 through the transparent plate 13. Light reflected from the surface of the original 9 is directed to the surface of the photosensitive drum 20 provided inside the main body 1 through a Selfoc lens 18. The surface of the photosensitive drum 20 before being exposed by the light from the Selfoc lens 18 is uniformly charged by a charging corona discharger 21. Therefore, an electrostatic latent image corresponding to an original image is formed on the surface of the photosensitive drum 20 after being exposed. The electrostatic latent image is developed into a toner image by a developing device 22. The toner image is led to the vicinity of the transferring corona discharger 24 by the rotation of the photosensitive drum 20 in a direction indicated by an arrow 23.

On the other hand, the sheet 4 led to the photosensitive drum 20 from the conveying path D1, D2, D3 or D4 is led to the vicinity of the transferring corona discharger 24 in a state where it is in contact with the surface of the photosensitive drum 20. The toner image on the surface of the photosensitive drum 20 is transferred to the sheet 4 by corona discharges in the transferring corona discharger 24. The sheet 4 to which the toner image has been transferred is separated from the surface of the photosensitive drum 20 by corona discharges in a separating corona discharger 25, and is further led to a fixing device 35 through a conveying path 34. In the fixing device 35, the sheet 4 is pressed and heated between a heat roller 37 and a pressure roller 38, whereby toner particles are is fixed to the surface of the sheet 4. The sheet 4 to which the toner has been fixed is discharged into the outside of the main body 1 by discharge rollers 36 through a discharge detecting switch 55, and is contained in the pocket 92 as guided by the guiding members 91. On the other hand, toner remaining on the surface of the photosensitive drum 20 after transferring the toner image is removed by a cleaning device 26, to prepare for formation of the subsequent electrostatic latent image.

Guide assisting plates 94 are arranged above the guiding members 91. The guide assisting plates 94 are rotatably supported on stays 95 mounted on the front surface 1*a* of the main body 1. The guide assisting plates 94 are rotatably displaceable between a guiding position where they hang down ahead of the guiding members 91 to guide, in cooperation with the guiding members 91, the discharged sheet to the pocket 92 (indicated by a two-dot and dash line in FIG. 1) and a containing position where they are held on the stays 95 (indicated by a solid line in FIG. 1).

The photosensitive drum 20, the developing device 22, the transferring corona discharger 24, and the like constitute image forming means. In the present embodiment, there are provided a main motor MM for driving the image forming means, a sheet feeding motor DM for driving a group of rollers for feeding the respective rolled-sheets 4A to 4C and also for driving the cut sheet 4D, a fixing motor FM for driving the heat roller 37, the pressure roller 38 in the fixing device 35, and an original feeding motor OM for driving the original conveying section 10.

Further referring to FIG. 1, a pulse output unit RD1 is provided in relation to the feeding reel 51. The pulse output unit RD1 comprises a rotating slit disk 202 which is rotated as the feeding reel 51 is rotated and a light-emitting/light-receiving element pair 203 fixedly arranged in the vicinity of the rotating slit disk 202. A number of slits are formed at equal spacing along the peripheral direction in the rotating slit disk 202. When the rotating slit disk 202 is rotated so that the positions of the slits are changed, the passage/interception of light fed from the light emitting element to the light receiving element is switched. Consequently, pulses corresponding to the rotation of the rotating slit disk 202 are outputted from the light receiving element in the light-emitting/light-receiving element pair.

The feeding reel 51 and the rotating slit disk 202 are coupled to each other by a plurality of gears, for example, whose illustration is omitted. It is contrived so that the rotating slit disk 202 is also rotated by the rotation of the feeding reel 51.

Similarly, a pulse output unit RD2 is provided in relation to the feeding reel 52, and a pulse output unit RD3 is provided in relation to the feeding reel 53. The pulse output unit RD2 also has a rotating slit disk 206 which is rotated as the feeding reel 52 is rotated and a light-emitting/light-receiving element pair 207. The pulse output unit RD3 also has a rotating slit disk 208 which is rotated as the feeding reel 53 is rotated and a light-emitting/light-receiving element pair 209. The pulse output units RD1, RD2, and RD3 are comprehensively referred to as a "pulse output unit RD" hereinafter, as required.

By such construction, when the rolled-sheets 4A, 4B, and 4C are conveyed toward the photosensitive drum 20, the feeding reels 51, 52, and 53 are rotated by forces applied from the rolled-sheets 4A, 4B, and 4C. Correspondingly, pulse signals are outputted from the pulse output units RD1, RD2, and RD3.

The feeding reel 51 and the rotating slit disk 202 may be coupled to each other by a plurality of gears or the like, as described above. Alternatively, the feeding reel 51 and the rotating slit disk 202 may be constructed, similarly to the feeding reel 52 and the rotating slit disk 206 which are constructed so that the rotating slit disk 206 is directly rotated by the rotation of the feeding reel 52. Alternatively, the feeding reel 51 and the rotating slit disk 202 may be interlocked by not gears but a belt or a belt and a pulley.

The pulse output units RD1, RD2, and RD3 may be provided in suitable positions which are out of the way within the main body 1. The pulse output unit and the feeding reel may be connected to each other by an arbitrary interlocking mechanism.

The pulse output units RD1, RD2, and RD3 may be replaced with pulse output units of the other construction. For example, a pulse output unit constructed so that the rotating slit disk provided with slits is replaced with a rotating disk having a number of magnet pieces embedded therein at equal spacing along the peripheral direction, and the light-emitting/light-receiving element pair is replaced with a proximity sensor. Alternatively, such a unit that a rotating disk which is projected and recessed at equal spacing along the peripheral direction is used, and a contact member in contact with the rotating disk is provided so that pulses are obtained from the contact member may be used.

Figure 4:
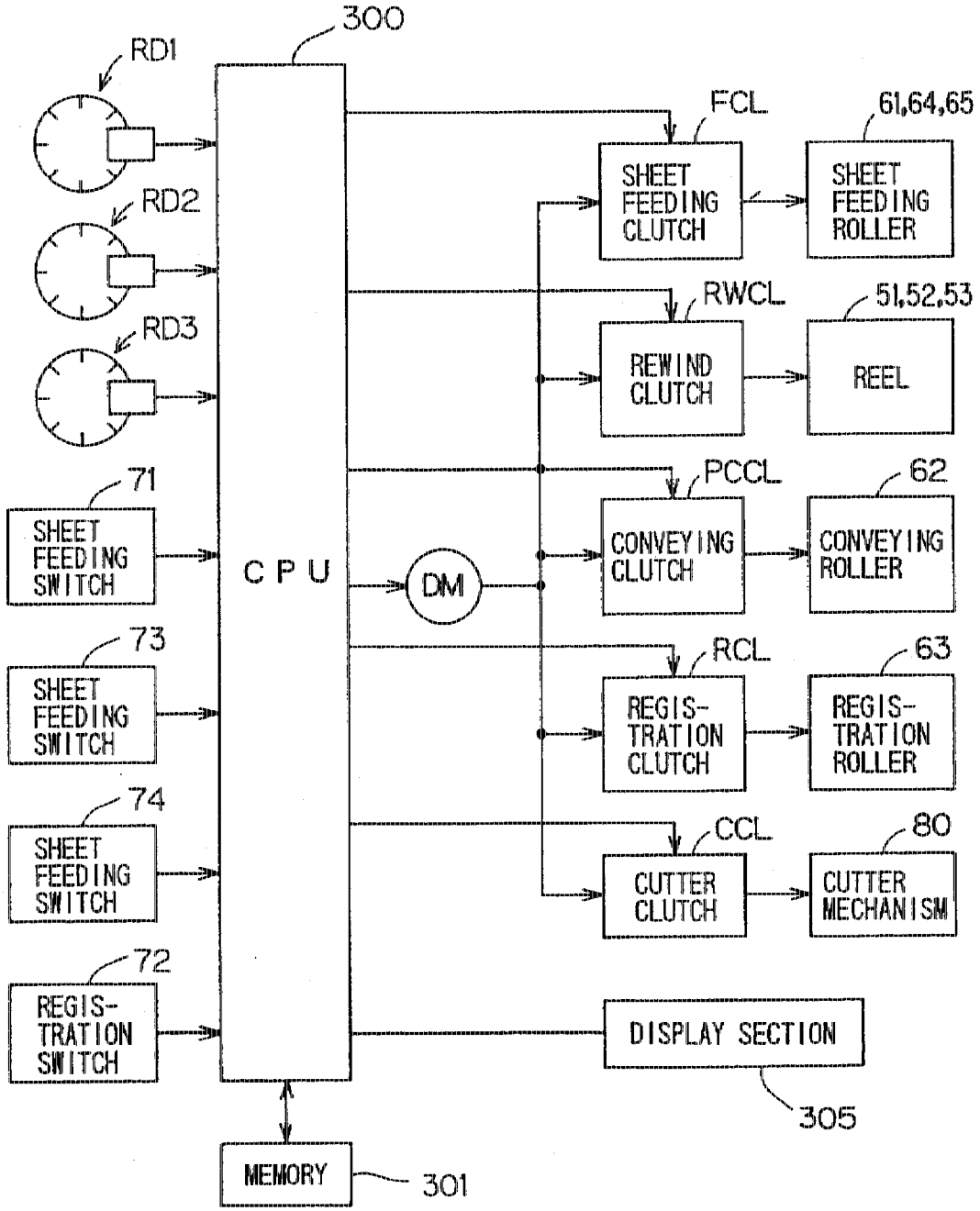
FIG. 4 is a block diagram showing the electrical construction for judging, when a rolled-sheet is used up, which of a bonded rolled-sheet and an unbonded rolled-sheet is the rolled-sheet.

FIG. 4 is a block diagram showing the electrical construction for judging, when any one of the rolled-sheets 4A, 4B, and 4C has been used up, which of a bonded rolled-sheet and an unbonded rolled-sheet has been the rolled-sheet.

Pulses generated from the pulse output units RD1, RD2, and RD3 are fed to a CPU 300. Outputs from the sheet feeding switches 71, 73, and 74 and the registration switch 72 are fed to the CPU 300. Although outputs of all the switches shown in FIG. 1 are inputted to the CPU 300, the illustration of parts of the switches is omitted in FIG. 5, in order to make the construction easy to understand.

The CPU 300 controls the sheet feeding motor DM, a sheet feeding clutch FCL, a rewind clutch RWCL, a conveying clutch PCCL, a registration clutch RCL, and a cutter clutch CCL on the basis of input signals from the respective switches and the pulse output units RD1, RD2, and RD3.

The sheet feeding clutch FCL can be switched between a state where torque in the sheet feeding motor DM is transmitted to the sheet feeding rollers 61, 64, and 65 and a state where the torque is not transmitted to the sheet feeding rollers 61, 64, and 65. Although sheet feeding clutches FCL are actually provided so as to respectively correspond to the sheet feeding rollers 61, 64, and 65, only one sheet feeding clutch is illustrated in FIG. 4 in order to prevent the drawing from being complicated.

The rewind clutch RWCL can be switched between a state where the torque in the sheet feeding motor DM is transmitted to the feeding reels 51, 52, and 53 and a state where the torque is not transmitted to the feeding reel. Although rewind clutches RWCL are actually provided so as to respectively correspond to the feeding reels 51, 52, and 53, only one rewind clutch is illustrated in FIG. 4 in order to prevent the drawing from being complicated. If the rewind clutch RWCL is turned on, the feeding reel is rotated in the counterclockwise direction in FIG. 1. Consequently, a pulled-out portion of the rolled-sheet is wound up around the feeding reel.

The conveying clutch PCCL and the registration clutch RCL selectively transmit the torque of the sheet feeding motor DM, respectively, to the conveying rollers 62 and the registration rollers 63.

Furthermore, the cutter clutch CCL selectively transmits the torque of the sheet feeding motor DM to the cutter mechanism 80, to rotate the rotating blade 82 in the cutter mechanism 80 (see FIG. 1).

Although the CPU 300 actually controls the operation of driving circuits connected to the sheet feeding motor DM and the clutches FCL, RWCL, PCCL, RCL and CCL, the illustration of the driving circuits is omitted in FIG. 4.

A memory 301 comprising a RAM, a ROM, and the like is connected to the CPU 300. The CPU 300 controls the respective sections in accordance with a program previously stored in the ROM. The CPU 300 further controls a display section 305 provided in the operating section 100, to display various types of information including a report that a sheet has been used up. The display section 305 may be one using a liquid crystal display device or one using an LED (Light Emitting Diode) element.

Although the CPU 300 controls the operation of the entire copying machine according to the present invention, description will be made by taking up only an operation relating to processing for judging, when a rolled-sheet has been used up, which of a bonded rolled-sheet and an unbonded rolled-sheet is the rolled-sheet.

Figure 5:
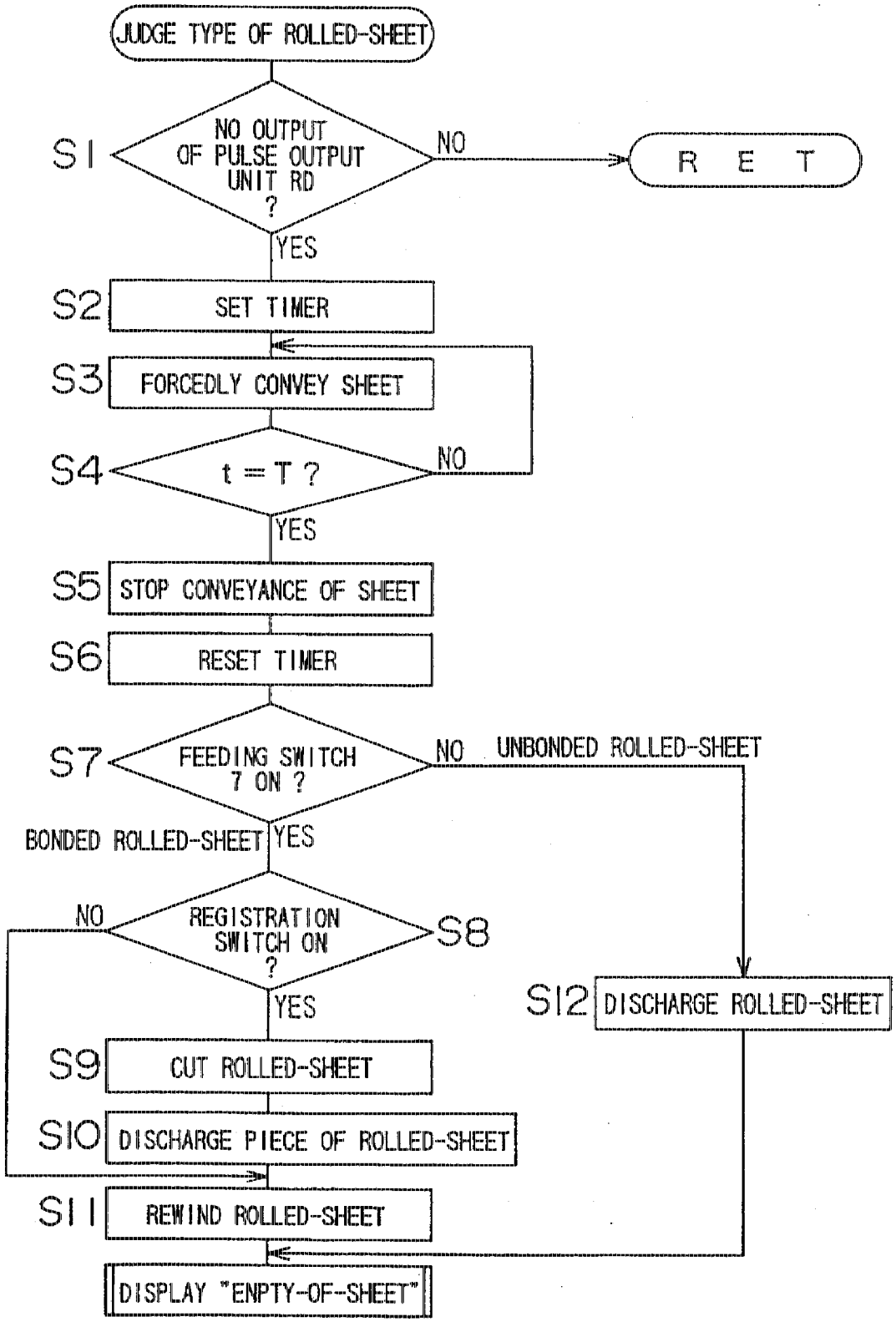
FIG. 5 is a flow chart for explaining processing for judging, when a rolled-sheet is used up, which of a bonded rolled-sheet and an unbonded rolled-sheet is the rolled-sheet.

FIG. 5 is a flow chart for explaining processing for judging, when a certain rolled-sheet has been used up, which of a bonded rolled-sheet and an unbonded rolled-sheet is the rolled-sheet. This processing is performed by the CPU 300 when the conveyance of the rolled-sheet 4 shown in FIG. 1 is started.

Referring to FIG. 5, when a copying operation is started, the rolled-sheet 4A, 4B or 4C is selected depending on the type of a sheet on which an original is to be copied, for example, a plain paper sheet, a tracing paper sheet, or a film sheet, and the conveyance of the selected rolled-sheet 4 is started. Processing for detecting the presence or absence of the selected rolled-sheet 4 is started at predetermined timing of interruption. That is, the presence or absence of an output of the pulse output unit RD corresponding to the selected rolled-sheet 4 is examined (step S1).

When the rolled-sheet 4 has been used up, the rotation of the feeding reel 51, 52 or 53 (hereinafter merely referred to as a "feeding reel 5") corresponding to the rolled-sheet 4 is stopped. That is, if the selected rolled-sheet 4 is a bonded rolled-sheet, the trailing end of the rolled-sheet is fixed to the feeding reel 5. When the rolled-sheet 4 has been used up, therefore, the rolled-sheet 4 is stopped in the conveying path D, not to move any more. As a result, the rotation of the feeding reel 5 is stopped. On the other hand, if the selected rolled-sheet 4 is an unbonded rolled-sheet, when the trailing end of the rolled-sheet 4 separates from the feeding reel 5, a force from the rolled-sheet 4 is not thereafter applied to the feeding reel 5. If the rolled-sheet 4 has been used up, therefore, the rotation of the feeding reel 5 is stopped. If the rolled-sheet 4 has been used up, the rotation of the feeding reel 5 is thus stopped irrespective of the type of the rolled-sheet 4.

No pulse signal is outputted from the pulse output unit RD as the feeding reel 5 is stopped. In response thereto, the CPU 300 judges that the rolled-sheet 4 has been used up, and further judges which of a bonded rolled-sheet and an unbonded rolled-sheet is the rolled-sheet 4. If a pulse signal is outputted from the pulse output unit RD, the following processing is not performed.

If the output from the pulse output unit RD is not detected, a timer is set (step S2), and an operation for forcedly conveying the rolled-sheet 4 is started (step S3). Forced-conveyance time t of the rolled-sheet 4 is measured by the timer, and the operation for forcedly conveying the rolled-sheet 4 is continued until the forced-conveyance time t has reached predetermined time T. The predetermined time T is determined on the basis of time elapsed from the time when the rolled-sheet 4 is pulled out from the feeding reel 5 until the leading end of the rolled-sheet 4 reaches the discharge detecting switch 55, for example, 10 seconds.

If it is confirmed in the step S4 that the forced-conveyance time t has reached the time T (10 seconds) (step S4), the operation for forcedly conveying the rolled-sheet 4 is stopped (step S5), and the timer is reset (step S6). Examples of the timer for measuring the forced-conveyance time t may be so-called software timer produced on a program or a hardware timer constructed using an integrating circuit or the like.

When the rolled-sheet 4 has been conveyed for the time T (10 seconds), the presence or absence of the rolled-sheet 4 is detected by the sheet feeding switch 71, 73 or 74 (hereinafter referred to as a "sheet feeding switch 7") corresponding to the rolled-sheet 4 (step S7). At this time, if the rolled-sheet 4 is not detected by the sheet feeding switch 7, it is judged that the rolled-sheet 4 is an unbonded rolled-sheet, whereby the rolled-sheet 4 conveyed to a halfway portion of the conveying path is forcedly discharged (step S12). That is, the trailing end of the unbonded rolled-sheet is not fixed to the feeding reel 5, whereby the rolled-sheet 4 is conveyed without being stopped. After the time T, the rolled-sheet 4 therefore does not exist in the position of the sheet feeding switch 7. Accordingly, it is appropriate in this case that the sheet 4 is conveyed in the direction of sheet conveyance on the conveying path and is discharged. The rolled-sheet 4 can be thus prevented from remaining on the conveying path.

Furthermore, "empty-of-sheet" is displayed on the display section 305 (see FIG. 4) provided in the main body of the copying machine.

If the rolled-sheet 4 is detected by the sheet feeding switch 7 (step S7), it is Judged that the rolled-sheet 4 is a bonded rolled-sheet. The reason for this is that the trailing end of the bonded rolled-sheet is fixed to the feeding reel 5, whereby the rolled-sheet 4 is stopped, not to be conveyed through the conveying path after the rotation of the feeding reel 5 has been stopped. If the rolled-sheet 4 is detected by the sheet feeding switch 7 after the conveyance for the time T, therefore, it can be judged that the rolled-sheet 4 is a bonded rolled-sheet.

If it is judged that the rolled-sheet 4 is a bonded rolled-sheet, it is examined whether or not the leading end of the rolled-sheet 4 has reached the cutter mechanism 80 on the basis of an output of the registration switch 72 (step S8). If the remaining portion of the rolled-sheet 4 is long, and the leading end of the rolled-sheet 4 has reached the registration switch 72, the cutter clutch CCL is turned on to drive the cutter mechanism 80, whereby the rolled-sheet is cut (step S9). A cut piece of the rolled-sheet is forcedly discharged (step S10), and the remaining rolled-sheet 4 is rewound up around the feeding reel 5 upon turning-on of the rewind clutch RWCL (step S11).

The cutting of the rolled-sheet 4 allows processing time to be shortened, as compared with a case where the entire long portion of the rolled-sheet is rewound up around the feeding reel 5. If a sheet portion where an unfixed toner image is formed between the transferring corona discharger 24 and the fixing device 35 is conveyed in the opposite direction along the conveying path, the conveying path, the rollers 33 and 63, and the like are contaminated. However, such contamination can be prevented by the cutting of the rolled-sheet 4.

When the rolled-sheet 4 has not reached the registration switch 72 in the step S8, the program proceeds to the processing in the step S11. In the step S11, the rolled-sheet 4 is rewound up around the feeding reel 5 upon turning-on of the rewind clutch RWCL. "Empty-of-sheet" is then displayed on the display section 305.

As described in the foregoing, according to the present embodiment, when the rolled-sheet has been used up, suitable processing is performed depending on which of a bonded rolled-sheet and an unbonded rolled-sheet is the rolled-sheet so that the rolled-sheet does not remain in the conveying path. Therefore, work for replacing rolled-sheets becomes easy. Further, when the rolled-sheet has been used up, "Empty-of-sheet" is displayed, whereby a user can quickly know the fact that the rolled-sheet is used up.

Although in the above-mentioned embodiment, description has been made by taking a copying machine as an example, the present invention is also applicable to the other image forming apparatuses such as a printer. Further, the present invention is also applicable to an apparatus for forming an image by a process other than an electrophotographic process, for example, an ink-jet process or a thermal transfer process.

Although the present invention has been described and illustrated in detail, it is clearly understood that the description is by way of illustration and example only and is not to be taken by way of limitation, the spirit and scope of the present invention being limited only by the terms of the appended claims.

What is claimed is:

1. An image forming apparatus, comprising:

image forming means for forming an image on a sheet;

sheet conveying means for pulling out a continuous sheet wound around a feeding reel and conveying the sheet through a predetermined conveying path passing through the image forming means;

reel rotation detecting means for detecting whether the feeding reel is in rotation or has stopped rotation;

sheet detecting means for detecting a presence or an absence of the sheet in a predetermined position on the conveying path; and judging means for judging, if the reel rotation detecting means has detected stopped rotation of the feeding reel while the continuous sheet is being conveyed by the sheet conveying means, whether or not a trailing end of the continuous sheet is fixed to the feeding reel on the basis of an output of the sheet detecting means.

2. An image forming apparatus according to claim 1, further comprising means for driving the sheet conveying means in order to discharge the sheet in the conveying path in response to a judgment by the judging means that the trailing end of the continuous sheet is not fixed to the feeding reel.

3. An image forming apparatus according to claim 1, further comprising means for driving the feeding reel to rotate in order to rewind the continuous sheet in the conveying path around the feeding reel in response to a judgment by the judging means that the trailing end of the continuous sheet is fixed to the feeding reel.

4. An image forming apparatus according to claim 1, further comprising cutter means provided in a predetermined position on the conveying path for cutting the continuous sheet, second sheet detecting means for detecting a presence or an absence of the continuous sheet at a predetermined position on the conveying path on a downstream side of the cutter means, means for operating the cutter means if the judging means judges that the trailing end of the continuous sheet is fixed to the feeding reel, and the second sheet detecting means is in detection of the continuous sheet, means for driving the sheet conveying means in order to discharge a sheet piece cut from the continuous sheet by the cutter means, and means for driving the feeding reel to rotate in order to return to the feeding reel a portion of the continuous sheet whose trailing end is fixed to the feeding reel.

5. An image forming apparatus according to claim 1, wherein the reel rotation detecting means is pulse outputting means for outputting pulses as the feeding reel is rotated.

6. An image forming apparatus according to claim 1, wherein the judging means comprises means for causing the sheet conveying means to convey the sheet for a predetermined time period after the reel rotation detecting means has detected stopped rotation of the feeding reel, and means for judging whether or not the trailing end of the continuous sheet is fixed to the feeding reel on the basis of the output of the sheet detecting means after conveyance of the sheet for the predetermined time period.

7. An image forming apparatus according to claim 1, further comprising display means for indicating that the continuous sheet has been used up if the reel rotation detecting means has detected stopped rotation of the feeding reel while the sheet is being conveyed by the sheet conveying means.

8. A method which is applied to an apparatus for forming an image on a pulled-out portion of a continuous sheet wound around a feeding reel, the method being a method for removing, when the continuous sheet has been used up, the sheet from a sheet conveying path, and the method comprising the steps of:

judging whether or not the continuous sheet has been used up;

judging whether or not a trailing end of the continuous sheet is fixed to the feeding reel if it is judged that the continuous sheet has been used up;

conveying, if it is judged that the trailing end of the continuous sheet is not fixed to the feeding reel, the sheet in a direction of sheet conveyance through the conveying path to pass through image forming means, thereby discharging the sheet; and rewinding, if it is judged that the trailing end of the continuous sheet is fixed to the feeding reel, the continuous sheet around the feeding reel.

9. An method according to claim 8, wherein the trailing end fixing judging step includes the steps of further conveying, if it is judged that the continuous sheet has been used up, the sheet in the direction of sheet conveyance for a predetermined time period after the judgment, and judging a presence or an absence of the sheet in a predetermined position on the conveying path after the continuous sheet has been conveyed for the predetermined time period.

10. A method according to claim 8, wherein the trailing end fixing judging step further includes the step of further conveying, if it is judged that the continuous sheet has been used up, the continuous sheet in the direction of sheet conveyance for a predetermined time period after the judgment, and the method further comprises the steps of:

providing cutter means for cutting the continuous sheet in a halfway portion of the conveying path;

detecting a presence or an absence of the sheet in a predetermined position of the conveying path on a downstream side of the cutter means, in the direction of sheet conveyance, after the sheet has been conveyed for the predetermined time period, operating the cutter means to cut the continuous sheet prior to rewinding of the continuous sheet around the feeding reel if the presence of the continuous sheet in the predetermined position is detected, and conveying a sheet piece cut from the continuous sheet in the direction of sheet conveyance and discharging the sheet piece to outside of the image forming apparatus.

* * * * *